US007665431B2

(12) United States Patent
Sun

(10) Patent No.: US 7,665,431 B2
(45) Date of Patent: Feb. 23, 2010

(54) DRIVE PISTON ASSEMBLY FOR A VALVE ACTUATOR ASSEMBLY

(75) Inventor: Zongxuan Sun, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 235 days.

(21) Appl. No.: 11/548,297

(22) Filed: Oct. 11, 2006

(65) Prior Publication Data

US 2008/0173264 A1 Jul. 24, 2008

(51) Int. Cl.
*F01L 9/02* (2006.01)

(52) U.S. Cl. ..... 123/90.12; 91/170 R

(58) Field of Classification Search ..... 123/90.12, 123/90.13; 137/493, 493.1; 91/170 R, 392
See application file for complete search history.

(56) References Cited

U.S. PATENT DOCUMENTS 3,792,715 A * 2/1974 Parrett et al. ..... 137/493
6,837,196 B2 1/2005 Sun ..... 123/90.12
6,959,673 B2 11/2005 Sun ..... 123/90.12

FOREIGN PATENT DOCUMENTS

DE 4443169 A1 * 6/1996

OTHER PUBLICATIONS

Turner et al. "Design and Control pf a Two-stage Electro-hydraulic Valve Actuation System" SAE Paper 2004-01-1265.

* cited by examiner

*Primary Examiner*—Ching Chang

(57) ABSTRACT

A drive piston assembly is provided that is operable to selectively open a poppet valve. The drive piston assembly includes a cartridge defining a generally stepped bore. A drive piston is movable within the generally stepped bore and a boost sleeve is coaxially disposed with respect to the drive piston. A main fluid chamber is at least partially defined by the generally stepped bore, drive piston, and boost sleeve. First and second feedback chambers are at least partially defined by the drive piston and each are disposed at opposite ends of the drive piston. At least one of the drive piston and the boost sleeve is sufficiently configured to move within the generally stepped bore in response to fluid pressure within the main fluid chamber to selectively open the poppet valve. A valve actuator assembly and engine are also provided incorporating the disclosed drive piston assembly.

18 Claims, 1 Drawing Sheet

DRIVE PISTON ASSEMBLY FOR A VALVE ACTUATOR ASSEMBLY

GOVERNMENT LICENSE RIGHTS

The U.S. Government has a paid-up license in this invention and the right in limited circumstances to require the patent owner to license others on reasonable terms as provided for by the terms of DE-FC-26-05NT42415 awarded by the Department of Energy.

TECHNICAL FIELD

The present invention relates to a drive piston assembly for a valve actuator assembly that is sufficiently configured for use with an internal combustion engine.

BACKGROUND OF THE INVENTION

It is known to provide a valve train or valve actuator assembly for an internal combustion engine of a vehicle. Typically, the valve train includes one or more intake and exhaust valves, a camshaft, driven by the engine and having at least one or more cams, and a rocker arm operatively connected with each cam and valve.

More recently, camless valve trains for internal combustion engines have been developed. Because of the ability to provide valve lift profiles tailored to specific engine operating conditions to improve engine performance, the camless valve train has been met with much enthusiasm by the internal combustion engine design community.

SUMMARY OF THE INVENTION

A drive piston assembly operable to selectively open a poppet valve is provided. The drive piston assembly includes a cartridge defining a generally stepped bore having a drive piston movable within the generally stepped bore. A boost sleeve is coaxially disposed with respect to the drive piston. A main fluid chamber is at least partially defined by at least one of the generally stepped bore, drive piston, and boost sleeve. First and second feedback chambers are at least partially defined by the drive piston, and each are disposed at opposite ends of the drive piston. At least one of the drive piston and the boost sleeve is sufficiently configured to move within the generally stepped bore in response to fluid pressure within the main fluid chamber to selectively open the poppet valve.

The drive piston assembly may further include a cap member defining a bore sufficiently configured to receive at least a portion of the drive piston, and mounted with respect to the cartridge. The cap member at least partially defines the second feedback chamber. The drive piston may include a shoulder portion operable to engage the boost sleeve to enable unitary movement between the drive piston and the boost sleeve. Additionally, the generally stepped bore may include a land operable to selectively limit the movement of the boost sleeve within the generally stepped bore to allow movement between the boost sleeve and the drive piston. A fluid chamber may be at least partially defined by at least one of the generally stepped bore, drive piston, and boost sleeve and is operable to exhaust fluid pressure from the main fluid chamber that may leak past the drive piston and the boost sleeve. Furthermore, the drive piston may be sufficiently configured to act directly on the poppet valve to enable the selective opening of the poppet valve.

The drive piston assembly is preferably sufficiently configured to be mountable within a valve actuator assembly, the valve actuator assembly includes a valve operable to selectively and variably communicate fluid pressure to the main fluid chamber. The first and second feedback chambers may be in fluid communication with the valve and may operate to vary the fluid pressure communicated to the main fluid chamber. The valve actuator assembly may further include a first on/off valve in fluid communication with the first feedback chamber and a second on/off valve in fluid communication with the second feedback chamber. The first and second on/off valves operate to selectively pressurize a respective one of the first and second feedback chamber. An internal combustion engine incorporating the disclosed drive piston assembly and valve actuator assembly is also provided.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
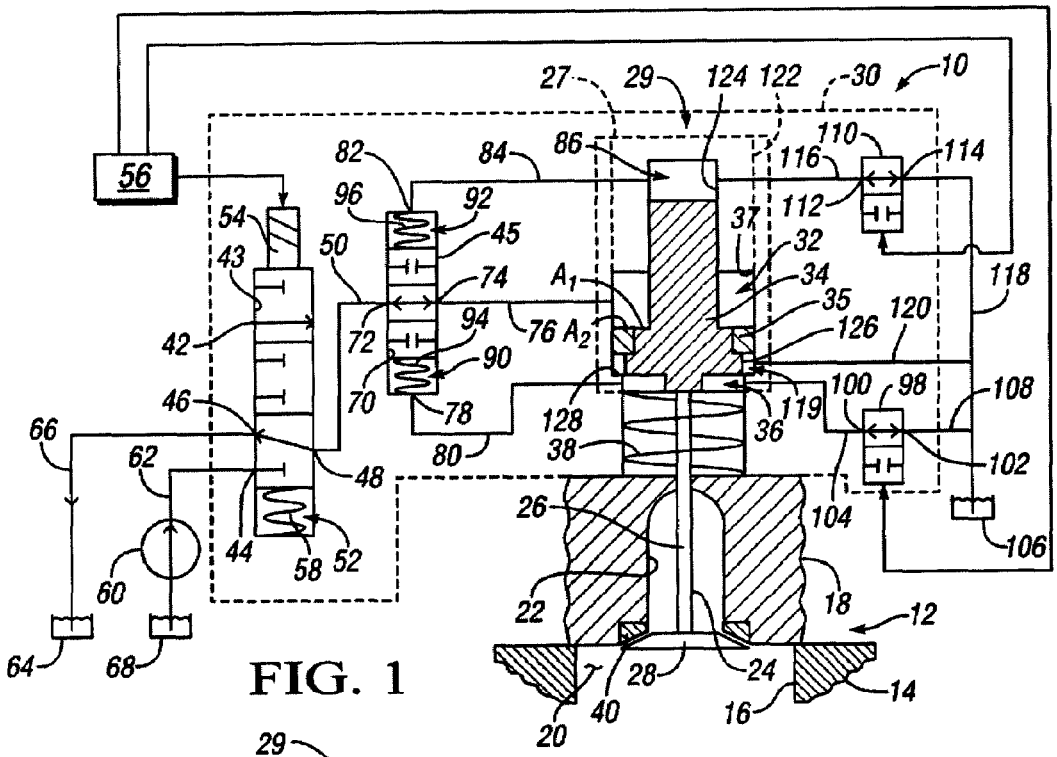
FIG. 1 is a schematic diagrammatic representation of a valve actuator assembly incorporating a drive piston assembly, in accordance with the present invention and illustrated in operational relationship with an engine of a vehicle.

Referring to the drawings wherein like reference numbers correspond to like or similar components throughout the several figures, there is shown in FIG. 1 a valve actuator assembly 10 in accordance with the present invention. The valve actuator assembly 10 is adapted for use with an engine, generally indicated at 12, of a vehicle, not shown. The engine 12 is of an internal combustion type, such as a spark ignited or compression ignited engine. The engine 12 includes an engine block 14 defining a cylinder bore 16 having a piston, not shown, reciprocally movable therein. Removably mounted to the engine block 14, and closing one end of the cylinder bore 16, is a cylinder head 18, a portion of which is shown in FIG. 1. The cylinder bore 16, cylinder head 18, and piston cooperate to at least partially define a variable volume combustion chamber 20. The cylinder head 18 defines at least one port or opening 22, which is in selective communication with the combustion chamber 20. The engine 12 also includes a movable poppet valve 24 operable to selectively open the port 22 to the combustion chamber 20. The poppet valve 24 has a valve stem portion 26 and a valve head portion 28 disposed at one end of the valve stem portion 26. It should be appreciated that the poppet valve 24 may be either an intake or an exhaust valve, while the respective port 22 may either be an intake or exhaust port. It should also be appreciated that the valve actuator assembly 10 operates as a camless valve train for the engine 12.

The valve actuator assembly 10 includes a drive piston assembly 29 having a cartridge 27 mounted with respect to a housing 30. The housing 30 is preferably mounted with respect to the cylinder head 18. The drive piston assembly 29 also includes a drive piston 34 connected to, or in contact with, the valve stem portion 26 of the poppet valve 24 at an end opposite the valve head portion 28. The drive piston 34 is shown schematically in FIG. 1 and is more accurately depicted in FIG. 2. Still referring to FIG. 1, a boost sleeve 35 is disposed generally coaxially about the drive piston 34. The drive piston 34 and boost sleeve 35 are reciprocally movable within a generally stepped bore 37 at least partially defined by the cartridge 27. The generally stepped bore 37, drive piston 34, and boost sleeve 35 cooperate to at least partially define a main fluid chamber 32. Additionally the generally stepped bore 37 and drive piston 34 cooperate to define a first feedback fluid chamber 36. The valve actuator assembly 10 includes a valve spring 38 coaxially disposed about the valve stem portion 26 of the poppet valve 24 and in contact with the cylinder head 18. The valve spring 38 operates to bias the poppet valve 24 toward a closed position. It should be appreciated that the valve head portion 28 cooperates with a seat 40, mounted with respect to the cylinder head 18, to seal or close the port 22 when the poppet valve 24 is in the closed position. The operation and features of the drive piston assembly 29 will be discussed in greater detail hereinbelow with reference to FIG. 2.

With continued reference to FIG. 1, the valve actuator assembly 10 also includes a spool valve 42 reciprocally moveable within a bore 43 defined by the housing 30. The spool valve 42 is in selective fluid communication with the main fluid chamber 32 through a spool valve 45. The spool valve 42 is of a three-position three-way type. The spool valve 42 has a high pressure port 44 and a low pressure port 46. The spool valve 42 also has a main fluid chamber port 48 in fluid communication with the spool valve 45 through an intermediate passage 50. The bore 43 and the spool valve 42 cooperate to define a spring chamber 52. The spool valve 42 controls fluid flow to and from the spool valve 45.

The valve actuator assembly 10 includes an actuator 54 disposed at an end of the spool valve 42 opposite the chamber 52. The actuator 54 is preferably of a linear type, such as a solenoid, electrically connected to a source of electrical power, such as a controller 56. The valve actuator assembly 10 further includes a spring member 58 disposed within the chamber 52 and operable to bias the spool valve 42 toward the actuator 54. The controller 56 selectively and variably energizes the actuator 54 to move the spool valve 42 within the bore 43 against the bias force of the spring member 58.

The valve actuator assembly 10 also includes a positive displacement hydraulic pump 60 and a high pressure passage 62 fluidly interconnecting the hydraulic pump 60 and the high pressure port 44. The valve actuator assembly 10 further includes a fluid reservoir 64 and a low pressure passage 66 fluidly interconnecting the fluid reservoir 64 and the low pressure port 46. It should be appreciated that the hydraulic pump 60 may be in fluid communication with the fluid reservoir 64 or a separate fluid reservoir 68, as shown in FIG. 1.

As stated hereinabove, the valve actuator assembly 10 includes the spool valve 45 disposed in fluid communication with the main fluid chamber 32 of the drive piston assembly 29. Additionally, the spool valve 45 is disposed in fluid communication with the spool valve 42. The spool valve 45 is of a three-position two-way type and is reciprocally movable within a bore 70 defined by the housing 30. The spool valve 45 has a first port 72 in fluid communication with the spool valve 42 by the intermediate passage 50, and a second port 74 in fluid communication with the main fluid chamber 32 by a drive passage 76. The spool valve 45 also includes a third port 78 fluidly connected by a first feedback passage 80 to the first feedback chamber 36 and a fourth port 82 fluidly connected by a second feedback passage 84 to a second feedback chamber 86, to be described hereinbelow. It should be appreciated that the spool valve 45 selectively and variably controls fluid flow to the main fluid chamber 32. The second feedback chamber 86 is at least partially defined by the drive piston 34. The bore 70 and spool valve 45 cooperate to define a fluid chamber 90 at one end of the spool valve 45, which is in fluid communication with the third port 78. Further, the bore 70 and spool valve 45 cooperate to define a fluid chamber 92, at the end of the spool valve 45 opposite the fluid chamber 90, in fluid communication with the fourth port 82.

The valve actuator assembly 10 includes a spring member 94 disposed within the fluid chamber 90 and operable to bias the spool valve 45 toward the center-biased position within bore 70, as shown in FIG. 1. Similarly, the valve actuator assembly 10 also includes a spring member 96 disposed within the fluid chamber 92 and operable to bias the spool valve 45 toward the center-biased position within bore 70. It should be appreciated that fluid pressure of sufficient magnitude within the fluid chamber 92 to overcome the force of the spring member 94 or within the fluid chamber 90 to overcome the force of the spring member 96 will bias the spool valve 45 away from the center biased position.

The valve actuator assembly 10 further includes a first on/off valve 98 disposed in fluid communication with the first feedback chamber 36. The first on/off valve 98 is preferably a two-way magnetically latchable type, and is responsive to command signals issued by the controller 56. The first on/off valve 98 has a first port 100 and a second port 102. The first port 100 is in fluid communication with the first feedback chamber 36 through a first on/off valve passage 104. Therefore, the first on/off valve 98 is operable to selectively pressurize the first feedback chamber 36. The valve actuator assembly 10 includes a fluid reservoir 106 in fluid communication with the second port 102 through a low pressure passage 108. It should be appreciated that the fluid reservoir 106 may operate as a low pressure fluid source. Those skilled in the art will recognize that the fluid reservoirs 64, 68, and 106 may be combined or separate, as shown in FIG. 1.

The valve actuator assembly 10 further includes a second on/off valve 110 in fluid communication with the second feedback chamber 86. The second on/off valve 110 is preferably a two-way magnetically latchable type and is responsive to command signals issued by the controller 56. The second on/off valve 110 has a first port 112 and a second port 114. The first port 112 is in fluid communication with the second feedback chamber 86 through a second on/off valve passage 116. Therefore, the second on/off valve 110 is operable to selectively pressurize the second feedback chamber 86. The fluid reservoir 106 is in fluid communication with the second port 114 through a low pressure passage 118. The low pressure passage 118 is in fluid communication with the fluid reservoir 106. A passage 120 is provided to communicate fluid from a chamber 119 to the fluid reservoir 106, as shown in FIG. 1, or a separate fluid reservoir. The chamber 119 is at least partially defined by the generally stepped bore 37, the drive piston 34, and the boost sleeve 35 and is sufficiently configured to contain and/or exhaust fluid that may leak between the drive piston 34, boost sleeve 35, and the cartridge 27.

Figure 2:
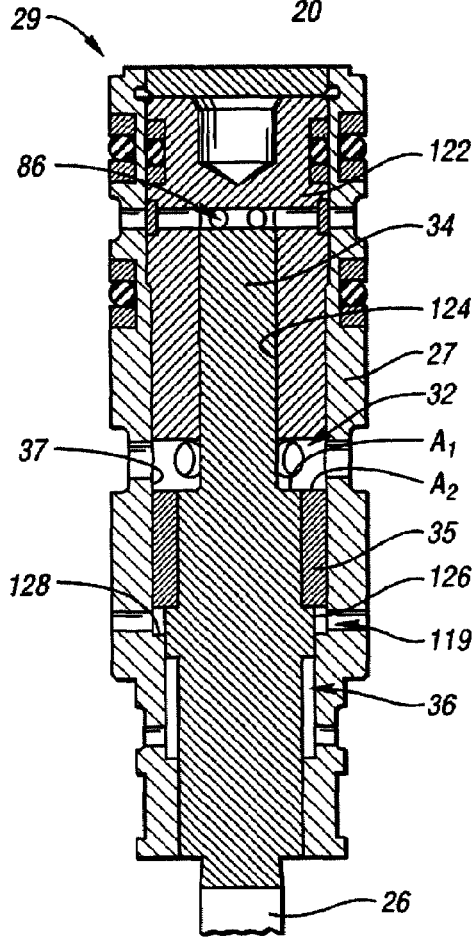
FIG. 2 is a cross sectional view of the drive piston assembly for use with the actuator assembly schematically depicted in FIG. 1, illustrating the features of the drive piston assembly.

Referring now to FIG. 2, there is shown a cross sectional view of the drive piston assembly 29. As described hereinabove, the cartridge 27 defines the generally stepped bore 37 within which at least a portion of the drive piston 34 is movable. The generally stepped bore 37 is sufficiently configured to receive a cap member 122. The cap member 122 operates to contain the drive piston 34 and the boost sleeve 35 within the generally stepped bore 37. The cap member 122 defines a bore 124 sufficiently configured to receive at least a portion of the drive piston 34. The drive piston 34 includes a generally annular shoulder portion 126, which the boost sleeve 35 engages to enable unitary sliding motion between the drive piston 34 and the boost sleeve 35. The generally stepped bore 37 includes a land portion 128 operable to selectively restrict the movement of the boost sleeve 35 within the generally stepped bore 37.

In operation, as the fluid pressure increases within the main fluid chamber 32, the bias force of the fluid pressure will engage an area A1 defined on the drive piston 34 and an area A2 defined on the boost sleeve 35. The bias force operable to bias the valve stem portion 26 of the poppet valve 24 can be characterized as the fluid pressure within the main fluid chamber 32 multiplied by the area A1 plus the area A2. As the drive piston 34 and boost sleeve 35 are biased downward, as viewed in FIG. 2, to open the poppet valve 24, the fluid volume of the first feedback chamber 36 decreases, while the volume of the second feedback chamber 86 increases. After moving downward for a predetermined distance, the boost sleeve 35 will engage the land 128 thereby mechanically stopping or preventing any further downward movement of the boost sleeve 35. The drive piston 34 will continue to move downward thereby continuing to bias the poppet valve 24 into the open position. The bias force acting on the poppet valve 24 is calculated as the fluid pressure within the main fluid chamber 32 multiplied by the area A1. Those skilled in the art will recognize that by varying the size of areas A1 and A2, the bias force of the drive piston 34 may be tuned for the specific application.

As fluid pressure within the main fluid chamber 32 is reduced, the valve spring 38 will bias the poppet valve 24 against the drive piston 34, thereby moving the drive piston 34 upward, as viewed in FIG. 2, within the generally stepped bore 37. After a predetermined distance, the shoulder portion 126 of the drive piston 34 will engage the boost sleeve 35 such that the drive piston 34 and boost sleeve 35 will move unitarily within the generally stepped bore 37. The drive piston 34 and boost sleeve 35 cooperate to drive fluid from the main fluid chamber 32. The bias force resisting the valve spring 38 can be characterized as the fluid pressure within the main fluid chamber 32 multiplied by the area A1 plus the area A2. Therefore, through control of the fluid pressure within the main fluid chamber 32, the deceleration of the poppet valve 24, prior to the impact of the valve head portion 28 with the seat 40, may be controlled. As the drive piston 34 and boost sleeve 35 move upward within the generally stepped bore 37, the fluid volume of the first feedback chamber 36 increases, while the volume of the second feedback chamber 86 decreases.

The operation of the valve actuator assembly 10 will now be discussed in greater detail with reference to FIGS. 1 and 2. With the poppet valve 24 in the closed position, i.e. the head portion 28 is in contact with the seat 40, the actuator 54 is de-energized so that the spring member 58 urges the spool valve 42 upward, as viewed in FIG. 1, to expose the intermediate passage 50 to the low pressure passage 66. The first and second on/off valves 98 and 110 are open so that both the first feedback chamber 36 and the second feedback chamber 86 are in fluid communication with the fluid reservoir 106. The spring member 94 and spring member 96 cooperate to hold or bias the spool valve 45 in the center-biased position. With the spool valve 45 in the center-biased position within the bore 70, as shown in FIG. 1, the main fluid chamber 32 is in fluid communication with the low pressure passage 66 through the intermediate passage 50 and the drive passage 76. With the main fluid chamber 32, first feedback chamber 36, and second feedback chamber 86 exhausted or in communication with their respective low pressure passage 66, 108, and 118, the valve spring 38 biases the poppet valve 24 into the closed position thereby disallowing communication between the port 22 and the combustion chamber 20.

To bias the poppet valve 24 into the open position from the closed position, the controller 56 energizes the actuator 54 thereby causing the actuator 54 to overcome the bias force of the spring member 58 and drive the spool valve 42 downward, such that the intermediate passage 50 is in fluid communication with the high pressure passage 62. The first and second on/off valves 98 and 110 remain open so that the first feedback chamber 36 and the second feedback chamber 86 are in fluid communication with the fluid reservoir 106 via the respective low pressure passages 108 and 118. Fluid is communicated under pressure to the main fluid chamber 32 through the drive passage 76. When the force of the pressurized fluid within the main fluid chamber 32 operating on the drive piston 34 and boost sleeve 35 is sufficient to overcome the force of the valve spring 38, the poppet valve 24 is biased toward open position.

To stop the poppet valve 24 at a predetermined lift position, such as when operating in a variable valve lift mode, the controller 56 commands the second on/off valve 110 to open and the first on/off valve 98 to close thereby disallowing fluid communication between the first feedback chamber 36 and the fluid reservoir 106. As the poppet valve 24 opens, the drive piston 34 urges fluid within the first feedback chamber 36 into the fluid chamber 90 via the first feedback passage 80, thereby urging the spool valve 45 upward, as viewed in FIG. 1, within the bore 70. This upward motion continues until the spool valve 45 blocks or prevents fluid communication between the drive passage 76 and the intermediate passage 50. When the spool valve 45 reaches this equilibrium point, the poppet valve 24 will stop at a desired lift position. It should be appreciated that the desired lift position is determined by the operational timing of the first on/off valve 98, which is controlled by the controller 56.

To close the poppet valve 24, the controller 56 de-energizes the actuator 54. The spring member 58 operates to bias the spool valve 42 upward to expose the intermediate passage 50 to the low pressure passage 66 and therefore the fluid reservoir 64. The first on/off valve 98 is commanded open by the controller 56 so that the first feedback chamber 36 is in fluid communication with the fluid reservoir 106. The spring member 94 and spring member 96 cooperate to bias the spool valve 45 to the center biased position. The pressurized fluid within the main fluid chamber 32 will exhaust to the fluid reservoir 64 via the drive passage 76, while the valve spring 38 operates to bias the poppet valve 24 into the closed position. It should be appreciated that the first and second on/off valves 98 and 110 are commanded open so that both the first feedback chamber 36 and the second feedback chamber 86 are in fluid communication with the fluid reservoir 106, causing the low pressure fluid to fill the first and second feedback chambers 36 and 86 as the poppet valve 24 closes.

To stop the poppet valve 24 at a predetermined position while the poppet valve 24 is returning to the closed position, the controller 56 commands the second on/off valve 110 to close thereby disallowing fluid communication between the second feedback chamber 86 and the fluid reservoir 106. As the poppet valve 24 closes, it will displace fluid from within the second feedback chamber 86 into the fluid chamber 92 thereby driving the spool valve 45 downward. This motion continues until the spool valve 45 substantially restricts fluid communication between the intermediate passage 50 and the drive passage 76. When the spool valve 45 reaches this equilibrium point, the poppet valve 24 will stop in the seated position. It should be appreciated that this feature allows for better control of the impact velocity as the head portion 28 of the poppet valve 24 impacts the seat 40 during the closing movement of the poppet valve 24.

The valve actuator assembly 10 of the present invention is made open loop stable by utilizing the first and second feedback passages 80 and 84. The on/off valves 98 and 110 are used to selectively pressurize or depressurize the first and second feedback passages 80 and 84, respectively. Open-loop stability implies that a system's response to a given input signal is bounded. The better controllability achieved by open loop stability enables the valve actuator assembly 10 to provide better performance. The valve actuator assembly 10 of the present invention precisely controls the motion of the spool valve 45 through the first and second feedback passages 80 and 84. Additionally, by using the boost sleeve 35 within the drive piston assembly 29 the total energy required to open the poppet valve 24 is reduced since the pressurized fluid within the main fluid chamber 32 acts on areas A1 and A2 for a portion of the duration of valve opening and on area A1 for the remainder. The boost sleeve 35 and drive piston 34 provide a high acceleration typically required at the opening of the poppet valve 24 and a reduction in acceleration as the valve lift progresses. The drive piston assembly 29 shown in FIG. 1 is direct acting, that is, the drive piston assembly 29 is in direct contact with the poppet valve 24. However, those skilled in the art will recognize that the drive piston assembly 29 of the present invention may be used in an indirect acting application if design or special constraints dictate while remaining within the scope of that which is claimed.

While the best modes for carrying out the invention have been described in detail, those familiar with the art to which this invention relates will recognize various alternative designs and embodiments for practicing the invention within the scope of the appended claims.

The invention claimed is:

1. A drive piston assembly operable to selectively open a poppet valve, the drive piston assembly comprising:

a cartridge defining a generally stepped bore;

a drive piston movable within said generally stepped bore;

a boost sleeve coaxially disposed with respect to said drive piston;

wherein the drive piston includes a shoulder portion operable to engage said boost sleeve to enable unitary movement between said drive piston and said boost sleeve;

a main fluid chamber at least partially defined by at least one of said generally stepped bore, drive piston, and boost sleeve;

first and second feedback chambers at least partially defined by said drive piston and each disposed at opposite ends of said drive piston; and wherein at least one of said drive piston and said boost sleeve is sufficiently configured to move within said generally stepped bore in response to fluid pressure within said main fluid chamber to selectively open the poppet valve.

2. The drive piston assembly of claim 1, further comprising:

a cap member defining a bore sufficiently configured to receive at least a portion of said drive piston and mounted with respect to said cartridge; and wherein said cap member at least partially defines said second feedback chamber.

3. The drive piston assembly of claim 1, wherein generally stepped bore includes a land operable to selectively limit the movement of said boost sleeve within said generally stepped bore to allow movement between said boost sleeve and said drive piston.

4. The drive piston assembly of claim 1, further comprising a fluid chamber at least partially defined by at least one of said generally stepped bore, drive piston, and boost sleeve and operable to exhaust fluid pressure from said main fluid chamber that may leak past said drive piston and said boost sleeve.

5. The drive piston assembly of claim 1, wherein said drive piston is sufficiently configured to act directly on the poppet valve to enable the opening of the poppet valve.

6. The drive piston assembly of claim 1, wherein the drive piston assembly is sufficiently configured to be mountable within a valve actuator assembly, the valve actuator assembly including a valve operable to selectively and variably communicate fluid pressure to said main fluid chamber.

7. The drive piston assembly of claim 6, wherein said first and second feedback chambers are in fluid communication with said valve and are operable to vary the fluid pressure communicated to said main fluid chamber.

8. The drive piston assembly of claim 7, wherein the valve actuator assembly includes:

a first on/off valve in fluid communication with said first feedback chamber; and a second on/off valve in fluid communication with said second feedback chamber; and wherein said first and second on/off valves are operable to selectively pressurize a respective one of said first and second feedback chamber.

9. The drive piston assembly of claim 6, wherein said valve is a spool valve.

10. A valve actuator assembly for selectively opening a poppet valve, the valve actuator assembly comprising:

a first valve in selective fluid communication with a source of fluid pressure;

a drive piston assembly having:

a cartridge defining a generally stepped bore;

a drive piston movable within said generally stepped bore;

a boost sleeve coaxially disposed with respect to said drive piston;

wherein the drive piston includes a shoulder portion sufficiently configured to engage said boost sleeve to enable unitary movement between said drive piston and said boost sleeve;

a main fluid chamber at least partially defined by said generally stepped bore, drive piston, and boost sleeve;

first and second feedback chambers at least partially defined by said drive piston and each disposed at opposite ends of said drive piston;

wherein at least one of said drive piston and said boost sleeve is sufficiently configured to move within said generally stepped bore in response to fluid pressure within said main fluid chamber to selectively open the poppet valve; and wherein said first valve is operable to selectively and variably communicate fluid pressure to said main fluid chamber.

11. The valve actuator assembly of claim 10, wherein said drive piston assembly further includes:

a cap member defining a bore sufficiently configured to receive at least a portion of said drive piston and mounted with respect to said cartridge; and wherein said cap member at least partially defines said second feedback chamber.

12. The valve actuator assembly of claim 10, wherein said generally stepped bore includes a land operable to selectively limit the movement of said boost sleeve within said generally stepped bore.

13. The valve actuator assembly of claim 10, further comprising:

a first on/off valve in fluid communication with said first feedback chamber; and a second on/off valve in fluid communication with said second feedback chamber.

14. The valve actuator assembly of claim 10, wherein said first and second feedback chambers are in fluid communication with said first valve and operate to vary the fluid pressure communicated to said main fluid chamber by said first valve.

15. The valve actuator assembly of claim 13, further comprising;

a second valve operable to selectively communicate pressurized fluid to said first valve;

a controller; and wherein at least one of said second valve, first on/off valve, and second on/off valve are controlled by said controller.

16. The valve actuator assembly of claim 15, wherein at least one of said first and second valves are spool valves.

17. An internal combustion engine comprising:

a cylinder head defining a port and at least partially defining a combustion chamber;

a poppet valve operable to enable selective communication between said port and said combustion chamber;

a valve actuator assembly operable to selectively open said poppet valve, said valve actuator assembly including;

a first valve in selective fluid communication with a source of fluid pressure;

a drive piston assembly having:

a cartridge defining a generally stepped bore;

a drive piston movable within said generally stepped bore;

a boost sleeve coaxially disposed with respect to said drive piston;

a main fluid chamber at least partially defined by said generally stepped bore, drive piston, and boost sleeve;

first and second feedback chambers at least partially defined by said drive piston and each disposed at opposite ends of said drive piston;

wherein at least one of said drive piston and said boost sleeve is sufficiently configured to move within said generally stepped bore in response to fluid pressure within said main fluid chamber to selectively open the poppet valve;

wherein the drive piston includes a shoulder portion operable to engage said boost sleeve to enable unitary movement between said drive piston and said boost sleeve;

wherein said generally stepped bore includes a land operable to selectively limit the movement of said boost sleeve within said generally stepped bore; and wherein said first valve is operable to selectively and variably communicate fluid pressure to said main fluid chamber.

18. The internal combustion engine of claim 17, wherein said first and second feedback chambers are in fluid communication with said first valve and operate to vary the fluid pressure communicated to said main fluid chamber by said first valve.

* * * * *